US005430939A

United States Patent [19]

Johnston

[11] Patent Number: 5,430,939

[45] Date of Patent: Jul. 11, 1995

[54] SAFETY RAZORS

[75] Inventor: Richard Johnston, Reading, United Kingdom

[73] Assignee: The Gillette Company, Boston, Mass.

[21] Appl. No.: 104,103

[22] PCT Filed: Feb. 24, 1992

[86] PCT No.: PCT/GB92/00325

§ 371 Date: Aug. 16, 1993

§ 102(e) Date: Aug. 16, 1993

[87] PCT Pub. No.: WO92/15430

PCT Pub. Date: Sep. 17, 1992

[30] Foreign Application Priority Data

Feb. 27, 1991 [GB] United Kingdom ..... 9104128
Mar. 20, 1991 [GB] United Kingdom ..... 9113336

[51] Int. Cl.[6] ..... B26B 21/44
[52] U.S. Cl. ..... 30/41; 30/50
[58] Field of Search ..... 30/32, 34.05, 41, 48, 30/49, 50, 62, 77, 90; 525/221; 526/318.4; 424/73

[56] References Cited

U.S. PATENT DOCUMENTS

| | | | |
|---|---|---|---|
| 4,170,821 | 10/1979 | Booth | 30/41 |
| 4,381,293 | 4/1983 | Michel | 30/90 X |
| 4,624,051 | 11/1986 | Apprille et al. | 30/50 |
| 4,850,106 | 7/1989 | Braun et al. | 30/41 |
| 4,872,263 | 10/1989 | Etheredge, III | 30/41 |
| 4,875,287 | 10/1989 | Creasy et al. | 30/34.01 |
| 5,094,912 | 3/1992 | Deibig et al. | 428/355 |
| 5,113,585 | 5/1992 | Rogers et al. | 30/41 |

FOREIGN PATENT DOCUMENTS 2024082 1/1980 United Kingdom .

*Primary Examiner*—Eugenia Jones
*Attorney, Agent, or Firm*—Stephan P. Williams

[57] ABSTRACT

A shaving unit (10) comprises at least one blade (13) and a blade support of moulded polymeric material which provides skin-engaging guard (11) and cap (12) surfaces, and the cap portion (12) and/or the guard portion (11) of the blade support is formed of at least one lubricious polymeric material which is more water-soluble under the conditions present during shaving than it is under other conditions, or of a mixture of such a lubricious polymeric material with one or more other materials.

11 Claims, 1 Drawing Sheet

SAFETY RAZORS

BACKGROUND OF THE INVENTION

This invention is concerned with safety razors of the kind comprising at least one blade and a blade support of moulded polymeric material which together form a shaving unit which is discarded as a whole when the cutting edge of the or each blade becomes dulled. The blade support is designed to form skin-engaging guard and cap surfaces for engaging the skin respectively ahead and rearwardly of the blade edge or edges.

The shaving unit may be of the disposable cartridge type adapted for coupling to and uncoupling from a razor handle or may be integral with the handle so that the complete razor is discarded as a unit when the blade or blades become dulled.

It is known to provide such shaving units with an insert which releases a lubricious water-soluble polymeric material in the presence of water; the use of such inserts significantly improves shaving comfort. A shaving unit having such an insert is described, for example, in British Specification 2024082B and shaving units of this kind have been commercially available for some years.

The preferred lubricious water-soluble polymeric material for such inserts is polyethylene oxide and this is the material which is, as far as is known, used in all commercially available shaving units of this kind. This polymer is subject to the disadvantage that it continues to leach from the insert after the shaving unit has been used because of the water it absorbs. This can cause unsightly and undesirable swelling of the insert and can lead to the insert sticking to surfaces, such as a razor tray, with which it comes into contact making it difficult to remove the razor when it is next wanted for use and, in extreme cases, leading to the insert being damaged when the razor is forcibly removed from the surface to which it is adhered.

Summary of the Invention

We have now found that the benefits of using a shaving unit with such an insert can be obtained, while avoiding or reducing the disadvantages referred to, by forming the cap and/or the guard portion of the blade support, or an insert in the cap and/or the guard portion, of a lubricious polymeric material which is selectively water soluble, that is which is more water-soluble under the conditions present during shaving (e.g. at pH's greater than 8 or a elevated temperatures) than it is under other conditions (e.g. at lower pH's or at ambient temperature).

Detailed Description of the Invention

Figure 1:
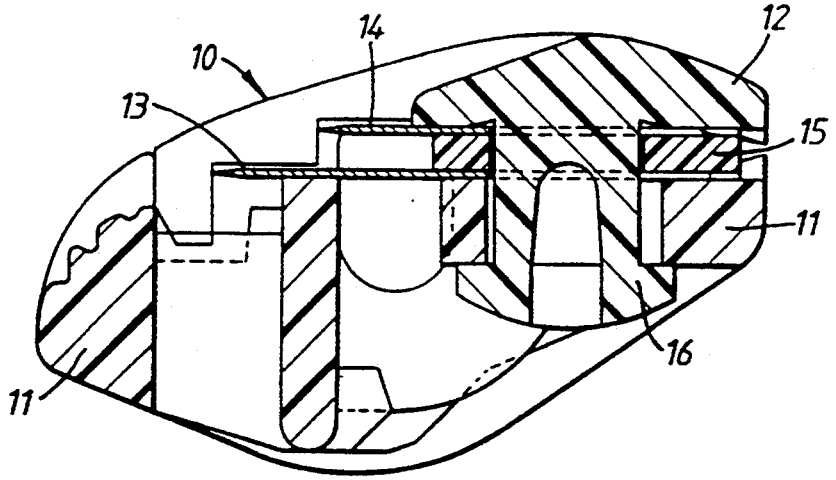

According to the present invention, there is provided a shaving unit which comprises at least one blade and a blade support of moulded polymeric material which provides skin-engaging guard and cap surfaces, in which the cap portion and/or the guard portion of the blade support, or a moulded insert in the cap portion and/or the guard portion, is formed of at least one lubricious polymeric material which is more water-soluble under the conditions present during shaving than it is under other conditions, or of a mixture of such a lubricious polymeric material with one or more other materials.

Whether the cap and/or guard portions or the moulded insert are formed of the lubricious polymeric material alone or of a mixture containing it depends on whether the mechanical properties of the lubricious polymeric material are such that the moulded polymer has sufficient strength to withstand normal usage. Where the moulded lubricious polymeric material does not have sufficient strength for this purpose, it is used in combination with one or more other mouldable materials which are adapted to provide the required strength. The other material is preferably a hydrophobic polymeric material; suitable hydrophobic polymers are, for example, polystyrene, polyethylene, polypropylene and polyacetal, that is the polymers which are conventionally used to make moulded shaving unit parts.

The lubricious polymer can, of course, be used in admixture with one or more other materials, such as the hydrophobic polymers just mentioned, even when it has sufficient strength to be used on its own. Such a mixture may be desirable in order to obtain specific moulding characteristics or to reduce the cost of the moulded parts if the lubricious polymer is costly.

Whilst the relative proportions of hydrophobic polymer and lubricious polymer in such mixtures are not critical, it is generally preferred that the mixture should comprise 60 to 20% by weight of the hydrophobic polymer(s) and 40 to 80% of the lubricious polymer(s).

Since many shaving soaps, creams and foams, for example those based on potassium soaps, have a high pH, for example in the range 8 to 10, one preferred class of lubricious polymers are polymers which exhibit high surface lubricity and have some degree of water-solubility at pHs of 8 to 9 and which are water-insoluble and non-lubricious at lower pHs. When a moulded shaving unit part or insert comprising such a polymer is used with such a high pH shaving soap, cream or foam, the polymer provides the desired lubricity under the high pH conditions prevailing during shaving, but as soon as the insert in rinsed in ordinary water (to reduce the ambient pH to about 7 or below) the polymer becomes insoluble and reverts to a non-lubricious state.

Suitable polymers of this kind are, for example, copolymers of an acrylate and/or a methacrylate, such as methyl acrylate or methyl methacrylate, and acrylic and/or methacrylic acid. A presently preferred polymer of this kind is a copolymer of 80% by weight of methyl acrylate and 20% by weight of methacrylic acid available under the trade designation GBC 1620 AC from Belland AG, Switzerland. This material can be used on its own to form the cap/or guard portion or the insert, that is it has sufficient strength, but it can also be used in admixture with one or more other mouldable polymers if desired.

Another class of lubricious polymers which can be used are polymers which are more soluble at elevated temperatures than they are at ambient temperature. Shaving is conventionally carried out with hot water and under these conditions, the lubricious polymer is available from the moulded part or insert. As soon as the moulded part or insert is rinsed in cold water, it becomes insoluble and non-lubricious.

Figure 2:
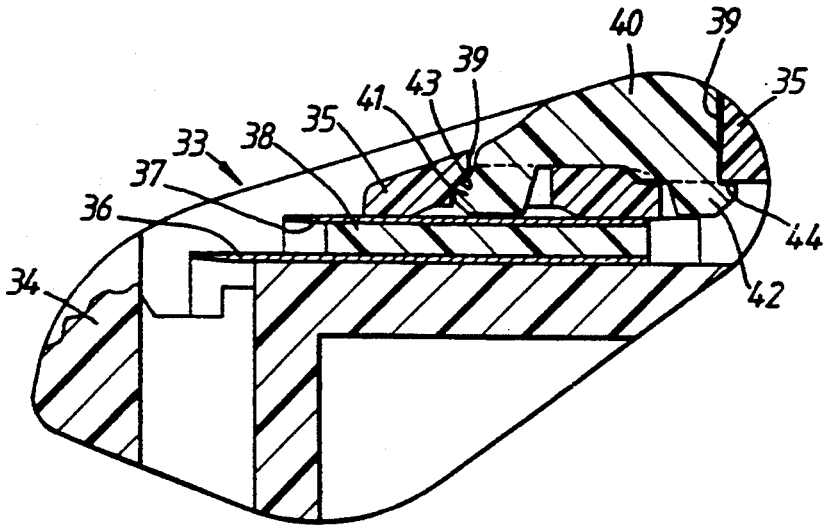

For the better understanding of the invention, preferred embodiments thereof will now be described, by way of example, with reference to the accompanying drawings, in which:

FIG. 1 is a cross-section of a shaving unit in which the cap portion is formed of a selectively water-soluble lubricious polymeric material, and FIG. 2 is a cross-section of a shaving unit having an insert formed of such a lubricious polymeric material.

The shaving unit shown in FIG. 1 is adapted for coupling to and uncoupling from a razor handle (not shown). The shaving unit, generally indicated at 10, comprises a moulded polymeric support made up of a guard portion 11 and a cap portion 12. Located between the guard portion 11 and the cap portion 12 are tandem blades 13 and 14 and a spacer 15 therebetween. The portions 11 and 12 are secured together, and the blades 13, 14 and spacer 15 are secured therebetween, by rivets 16 in a generally conventional manner; the rivets 16 are formed integrally with the cap portion 12.

Whilst the guard portion 11 is formed of a conventional polymeric material, such as a polystyrene, the cap portion 12 is formed of a lubricious polymeric material or of a mixture containing such a material as described above.

Following example is given by way of illustration only.

Example

A methyl acrylate (80%)/methacrylic acid (20%) copolymer available from Belland AG as GBC 1620 AC was injection moulded to form cap portions of a shaving unit of the kind shown in FIG. 1. The moulding conditions were as follows:

| | |
|---|---|
| barrel temperature, | |
| zone 2 | 50° C. |
| zone 1 | 220° C. |
| nozzle | 190° C. |
| injection pressure | 89 bar (1300 psi) |
| injection time | 1.7 sec |
| injection hold | 4.0 sec |
| cavity temperature | ambient |

The cap portions were assembled in a conventional manner with guard portions formed of conventional polymeric material, blades and spacers to form shaving units as shown in FIG. 1. The modified shaving units were used in shave tests in combination with an aerosol shaving foam which had a pH greater than 8. Used in this way, the cap portions acquired a high lubricity which resulted in shaves which were judged to be superior to those obtained with unmodified shaving units.

After shaving, the modified shaving units were rinsed under running tap water (having a pH of about 7 or below) and the cap portions immediately reverted to a non-lubricious, insoluble form.

The shaving unit shown in FIG. 2 is generally similar to that shown in FIG. 1 and is adapted for coupling to and uncoupling from a razor handle (not shown). The shaving unit, generally indicated at 33, comprises a moulded support made up of a guard portion 34 and a cap portion 35, both formed of a conventional polymeric material, such as a polystyrene. Located between the guard portion 34 and the cap portion 35 are tandem blades 36 and 37 and a spacer 38 therebetween. The portions 34 and 35 are secured together and the blades. 36,37 and spacer 38 are secured therebetween, by polymeric material rivets (not shown) in a generally conventional manner.

The cap portion 35 is provided with a recess 39 which extends longitudinally parallel to the cutting edges of the blades and which is terminated at each end by an end wall provided by the cap portion. Making a snap fit within the recess 39 is a moulded insert 40 comprising a lubricious polymer as described above, the insert 40 being provided with a forwardly projecting lug 41 and a rearwardly projecting lug 42 which engage corresponding undercut channels 43 and 44 in the recess 39.

Whilst in the embodiment shown in FIG. 2, the insert is located in a recess in the cap portion of the shaving unit, it may also be located in a recess in the guard portion or the insert, suitably in the form of a relatively thin strip, may be adhesively bonded to the cap or guard portion instead of being frictionally retained within a recess.

Shaving units of the latter kind, that is having a strip of selectively soluble lubricious polymer adhesively bonded to the cap portion of a shaving unit, have been made and tested. The polymer used was the GBC 1620AC methyl acrylate/methacrylic acid copolymer referred to above and it was moulded to form rectangular plates or strips having the dimensions 34 mm×3 mm×1 mm under the same moulding conditions as are described in the foregoing Example.

One of these moulded plates was secured to the cap of a commercially available twin blade disposable cartridge with cyanoacrylate adhesive. The modified cartridge was used in shave tests in combination with an aerosol shaving foam which had a pH greater than 8. Used in this way, the attached plate acquired a high lubricity which resulted in a shave which was judged to be superior to that obtained with an unmodified cartridge.

After shaving, the modified cartridge was rinsed under running tap water (having a pH of about 7 or below) and the attached plate immediately reverted to a non-lubricious, insoluble form.

I claim:

1. A shaving unit which comprises at least one blade and a blade support which provides a skin-engaging surface, wherein a portion of said skin-engaging surface comprises a lubricious polymer which is at least partially water soluble at a pH of 8 to 9 and water insoluble at a pH of 7 or below.

2. A shaving unit according to claim 1 wherein said blade support comprises a cap portion and a guard portion, at least one of which comprises said lubricious polymer.

3. A shaving unit according to claim 2 wherein said cap portion or said guard portion comprises a composite comprising from 40 to 80% by weight of said lubricious polymer and from 60 to 20% by weight of a hydrophobic polymer.

4. A shaving unit according to claim 3 wherein the hydrophobic polymer is polystyrene, polyethylene, polypropylene or polyacetal.

5. A shaving unit according to claim 2 wherein the lubricious polymer is a copolymer of (a) methyl acrylate and/or methyl methacrylate and (b) acrylic acid and/or methacrylic acid.

6. A shaving unit according to claim 5 wherein the lubricious polymer is a copolymer of 80% by weight methyl acrylate and 20% by weight methacrylic acid.

7. A shaving unit according to claim 2 wherein said cap portion or said guard portion includes a molded insert which comprises said lubricious polymer.

8. A shaving unit according to claim 7 wherein said molded insert comprises a composite comprising from 40 to 80% by weight of said lubricious polymer and from 60 to 20% by weight of a hydrophobic polymer.

9. A shaving unit according to claim 8 wherein the hydrophobic polymer is polystyrene, polyethylene, polypropylene or polyacetal.

10. A shaving unit according to claim 7 wherein the lubricious polymer is a copolymer of (a) methyl acrylate and/or methyl methacrylate and (b) acrylic acid and/or methacrylic acid.

11. A shaving unit according to claim 10 wherein the lubricious polymer is a copolymer of 80% by weight methyl acrylate and 20% by weight methacrylic acid.

* * * * *